US005386215A

United States Patent [19]

Brown

[11] Patent Number: 5,386,215

[45] Date of Patent: Jan. 31, 1995

[54] HIGHLY EFFICIENT PLANAR ANTENNA ON A PERIODIC DIELECTRIC STRUCTURE

[75] Inventor: Elliott R. Brown, Billerica, Mass.

[73] Assignee: Massachusetts Institute of Technology, Cambridge, Mass.

[21] Appl. No.: 979,291

[22] Filed: Nov. 20, 1992

[51] Int. Cl.[6] ..... H01Q 9/28

[52] U.S. Cl. ..... 343/795; 343/792.5

[58] Field of Search ..... 343/700 MS, 792.5, 756, 343/785, 909, 911 R; H01Q 9/28, 11/10

[56] References Cited

U.S. PATENT DOCUMENTS

| | | | |
|---|---|---|---|
| Re. 32,369 | 3/1987 | Stockton et al. | 343/700 MS |
| 5,041,839 | 8/1991 | Rees | 343/700 MS |
| 5,187,461 | 2/1993 | Brommer et al. | 333/219.1 |
| 5,216,680 | 6/1993 | Magnusson et al. | 372/20 |

FOREIGN PATENT DOCUMENTS

| | | |
|---|---|---|
| 0105103A3 | 4/1984 | European Pat. Off. . |
| 0188345 | 7/1986 | European Pat. Off. . |
| 0516981A1 | 12/1992 | European Pat. Off. . |
| WO92/14696 | 11/1990 | WIPO . |
| WO92/11547 | 7/1992 | WIPO . |
| WO92/16031 | 9/1992 | WIPO . |

OTHER PUBLICATIONS

Roberts, A., et al., "Bandpass Grids with Annular Apertures," *IEEE Transactions on Antennas and Propagation,* 36(5):607–611, (May 1988).

Otoshi, T. Y., et al., "Dual Passband Dichroic Plate for X-Band," *IEEE Transactions on Antennas and Propagation,* 40(10):1238–1245, (Oct. 1992).

Parfitt, A. J. et al., "On the Modeling of Metal Strip Antennas Contiguous with the Edge of Electrically thick Finite Size Dielectric Substrates," *IEEE Transactions on Antennas and Propagation,* 40(2):134–140, (Feb. 1992).

Rubin, B. J., "General Solution for Propagation, Radiation and Scattering in Arbitrary 3D Inhomogeneous Structures," *IEEE Antennas and Propagation Magazine,* 34(1): 17–25, (Feb. 1992).

Mailloux, R. J., "Phased Array Architecture for mm--Wave Active Arrays," *Microwave Journal,* 29(7):117–120 and 24, (Jul. 1986).

E. Yablonovitch et al., "Photonic Band Structure: The Face-Centered-Cubic Case Employing Nonspherical Atoms," *Physical Review Letters,* 67(17), 2295–2298 (1991).

David B. Rutledge et al., "Imaging Antenna Arrays," *IEEE Transactions on Antennas and Propagation,* AP-30(4), 535–540 (1982).

D. B. Rutledge, "Integrated-Circuit Antennas," *Infrared and Millimeter Waves,* vol. 10, 1–90, (1983).

E. Yablonovitch et al., "Photonic band structure: the face-centered-cubic case," *J. Opt. Soc. Am.,* 7(9), 1792–1800, (1990).

Eli Yablonovitch, "Inhibited Spontaneous Emission in Solid-State Physics and Electronics," *Physical Review Letters,* 58(20), 2059–2062, (1987).

Sajeev John, "Strong Localization of Photons in Certain Disordered Dielectric Superlattices," 58(23), 2486–2489, (1987).

G. Kurizki et al., "Suppression of Molecular Interactions in Periodic Dielectric Structures," *Physical Review Letters,* 61(19), 2269–2271, (1988).

*Primary Examiner*—Donald Hajec
*Assistant Examiner*—Tan Ho
*Attorney, Agent, or Firm*—Hamilton, Brook, Smith & Reynolds

[57] ABSTRACT

Efficient transmission and reception of electromagnetic radiation are achieved by an antenna on a substrate. An antenna is fabricated on the top surface of a substrate which includes a periodic dielectric structure. The antenna operates at a frequency within the band gap of the periodic dielectric structure. Radiation emitted by the antenna cannot propagate through the structure and is therefore emitted only into space away from the substrate. When the antenna is receiving, radiation striking the device does not propagate through the substrate but is concentrated at the antenna. A phased array with isolated elements is achieved by fabricating the array elements on top of a substrate having a periodic dielectric structure and by surrounding the circuits associated with each antenna element with the periodic dielectric structure. Radiation from an element or associated circuitry at a frequency within the band gap of the structure cannot propagate into the substrate to interfere with other elements.

53 Claims, 9 Drawing Sheets

HIGHLY EFFICIENT PLANAR ANTENNA ON A PERIODIC DIELECTRIC STRUCTURE

GOVERNMENT SUPPORT

This invention was made with government support under Contract Number F19628-90-C-0002 awarded by the Air Force. The government has certain rights in the invention.

BACKGROUND OF THE INVENTION

Planar antennas are typically mounted on dielectric substrates to facilitate their use in hybrid circuits. They have been used extensively on substrates having low dielectric constants.

As the demand for high frequency devices has increased, however, substrates with low dielectric constants have become less and less useful. The parasitic reactances of the hybrid circuits have a significant detrimental effect on the operability of the constituent devices at high frequency.

It has become desirable, therefore, to implement planar antennas on higher dielectric semiconductor substrates. Monolithic integrated circuits which include the devices, antennas and associated interconnects would greatly improve high frequency performance. Unfortunately, efficient planar antennas have been difficult to implement on uniform semiconductor substrates. Because of the high dielectric constant of semiconductors, most of the radiation emitted by the antenna passes into and is trapped by the substrate, resulting in inefficient antennas. In these conventional integrated circuits, the higher the dielectric constant of the substrate, the less efficient the planar antenna.

Several techniques have been proposed to solve this problem. One technique is to place a conducting plane on the bottom surface of the substrate opposite the antenna. The conductor reflects radiation back toward the top surface. However, the power radiated through the top surface is increased by only about a factor of two. Most of the power still remains trapped in the substrate.

A second approach is to modify the bottom surface so that all of the radiation escapes. This is accomplished with a hyper-hemispherical lensing element having the same dielectric constant as the substrate. The problem with this approach is that the lensing element is so large as to be incompatible with integrated circuits.

SUMMARY OF THE INVENTION

The present invention involves an apparatus and method for transmitting or receiving electromagnetic radiation. The invention, in general, comprises an antenna on a substrate. A portion of the substrate underlying the antenna is formed with a periodic dielectric structure which provides a frequency band gap or photonic band gap. A periodic dielectric structure or periodic structure as referred to in this application is a body of material having a periodic variation in dielectric constant. The materials used to make such a structure can include but are not limited to semiconductors, ceramics, and metals. The frequency band gap of the periodic structure is a range of frequencies of electromagnetic radiation which are substantially prevented from propagating into the substrate. The antenna operates to transmit or receive electromagnetic radiation at frequencies within the frequency band gap.

The periodic dielectric structure may be provided with two-dimensional periodicity, or three-dimensional periodicity. The periodic dielectric structure can be a photonic crystal.

In one embodiment of the invention a single planar antenna is formed over the periodic dielectric structure. The antenna transmits or receives at a frequency within the band gap of the structure. When transmitting, the antenna is driven at an operating frequency within the band gap. Because the radiation at this frequency cannot propagate into the structure, it is forced to radiate from the antenna into space, thus preventing the trapping and absorption of power in the substrate. The antenna and associated circuitry can also be completely surrounded by the periodic dielectric structure to isolate it from other circuits on the substrate.

In another embodiment of the invention a monolithic structure comprising a plurality of antenna elements forming a phased array is formed on a surface of a substrate. The improved efficiency obtained in the single antenna is also achieved in the phased array. The elements of the phased array can also be isolated from each other by a periodic structure formed in the substrate between antenna elements. Because the frequencies at which the elements operate are within the band gap, the signals cannot propagate among the elements through the substrate. Thus, "crosstalk" between elements is virtually eliminated.

In a preferred embodiment, the antenna circuit comprises a dipole or slot antenna driven by a stripline. Other types of antennas which may be used include, but are not limited to, bow-ties, spirals, and log periodicals. The substrate material can be gallium arsenide, indium phosphide, other III-V compound semiconductors, silicon, ceramics such as alumina or silica, epoxy-based dielectrics, metals or similar materials.

The antenna of the present invention provides numerous advantages. Because the antenna can be fabricated directly upon a semiconductor substrate having a high dielectric constant, monolithic circuits which include the antenna can be integrated into the substrate along with the antenna and periodic structure which forms the band gap. Parasitic reactances are reduced, and, therefore, operation at higher frequencies is improved.

The monolithic device provided by the present invention is more compact than prior hybrid counterparts. The planar antenna of the present invention is fabricated directly on the semiconductor substrate along with its associated circuitry. The need for bulky feed horns and other components is eliminated.

Because of the band gap of the periodic structure, much more power is radiated or received by the antenna than is trapped and absorbed by the substrate. Thus, a more efficient radiating or receiving antenna is produced.

BRIEF DESCRIPTION OF THE DRAWINGS

The foregoing and other objects, features and advantages of the invention will be apparent from the following more specific description of preferred embodiments of the invention, as illustrated in the accompanying drawings. In the drawings, like reference characters refer to the same parts throughout the different views. The drawings are not necessarily to scale, emphasis instead being placed upon illustrating the principles of the invention.

DETAILED DESCRIPTION OF THE INVENTION

Figure 1A:
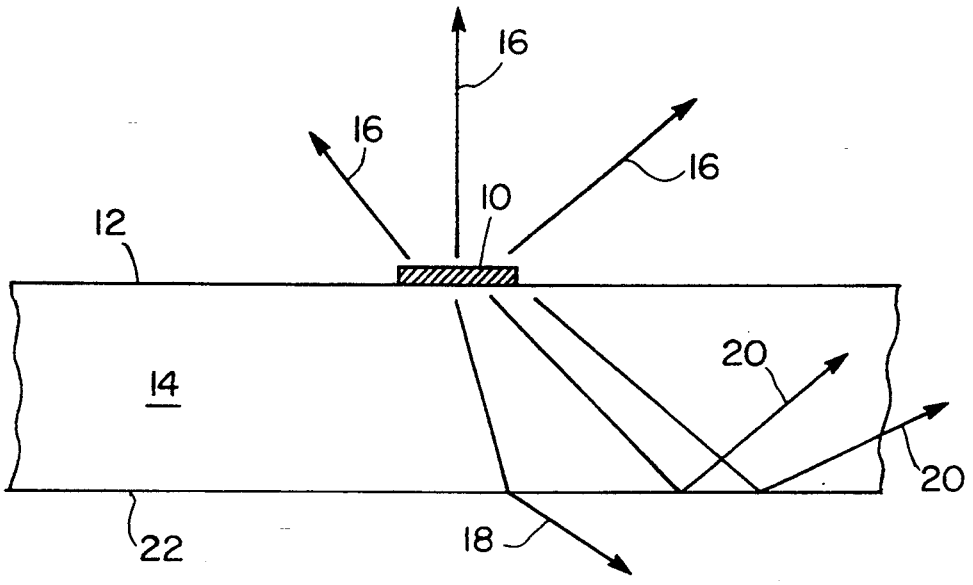
FIG. 1A PRIOR ART
FIG. 1*a* is a schematic cross-sectional view of a prior art conventional planar antenna fabricated on the top surface of a semiconductor substrate.

FIG. 1*a* illustrates a conventional prior art planar antenna 10 fabricated on the top surface 12 of a uniform semiconductor substrate 14. The antenna 10 is comprised of conductive metal strips formed of gold, aluminum, platinum, or the like and is driven by electronic components such as driving circuitry (not shown) to emit electromagnetic radiation.

When the antenna 10 in FIG. 1*a* is driven, it emits radiation 16, 18, 20 in all directions as shown. Some of the radiation is directed away from the substrate 14 into space as indicated by arrows 16. Some of the radiation 18 passes through the substrate 14 and is emitted from the bottom surface 22 of the substrate 14. The remainder of the radiation 20 is trapped within the substrate 14 by internal reflection. The trapped radiation will likely be absorbed or coupled to other striplines on the substrate.

The amount of power radiated into the substrate 14 $P_S$ compared with that radiated out of the substrate $P_A$ is a function of the dielectric constant $\epsilon$ of the substrate. An approximate expression for the ratio of the powers radiated in the two directions is given by $$P_S/P_A=\epsilon^{3/2};$$

It can be seen that a high dielectric constant causes a far greater amount of radiation to be emitted into the substrate, and therefore results in a less efficient antenna. Semiconductor materials have relatively high dielectric constants and have therefore previously been inefficient as substrates for planar antennas. As an example, for gallium arsenide ($\epsilon \approx 13$), approximately 46.9 times more power is radiated into the substrate than is radiated into the air. By reciprocity, 46.9 times more received power is trapped in the substrate than is propagated along the antenna to receiving components (not shown).

Figure 1B:
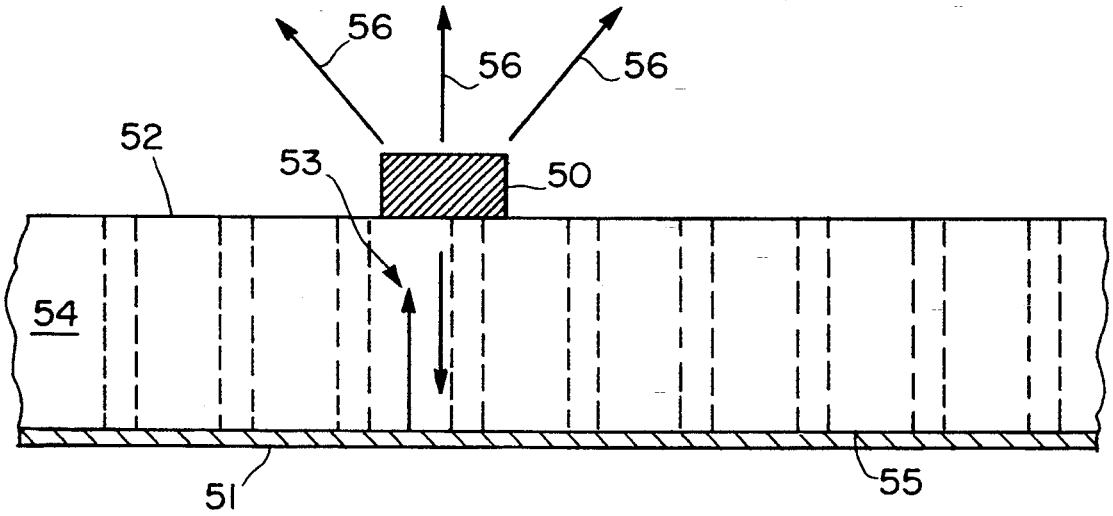
FIG. 1*b* is a schematic cross-sectional view of a planar antenna fabricated on the top surface of a semiconductor periodic dielectric structure in accordance with the present invention.

FIG. 1*b* schematically depicts an embodiment of the present invention. A planar antenna 50 is fabricated on the top surface 52 of a two-dimensional periodic dielectric substrate 54 which forms a photonic crystal. The two-dimensional periodic structure prevents radiation from propagating laterally along the substrate 54. However, radiation can propagate vertically into the substrate. A conducting plane 51 is fabricated on the bottom surface 55 of the substrate 54 to reflect this radiation back to the top surface 52 of the substrate. Arrows 53 depict the vertical propagation and opposing reflection of the radiation. The substrate material can be gallium arsenide, indium phosphide, other III-V compound semiconductors, silicon, ceramics, metals, epoxy-based dielectrics, or similar material.

In the transmit mode, the planar antenna 50 in FIG. 1*b* is driven at a frequency within the band gap of the substrate structure. Because the radiation emitted by the antenna 50 cannot propagate through the substrate 54, it is radiated away from the substrate and into space as indicated by the arrows 56. Thus, a much more efficient planar antenna is produced.

Figure 2:
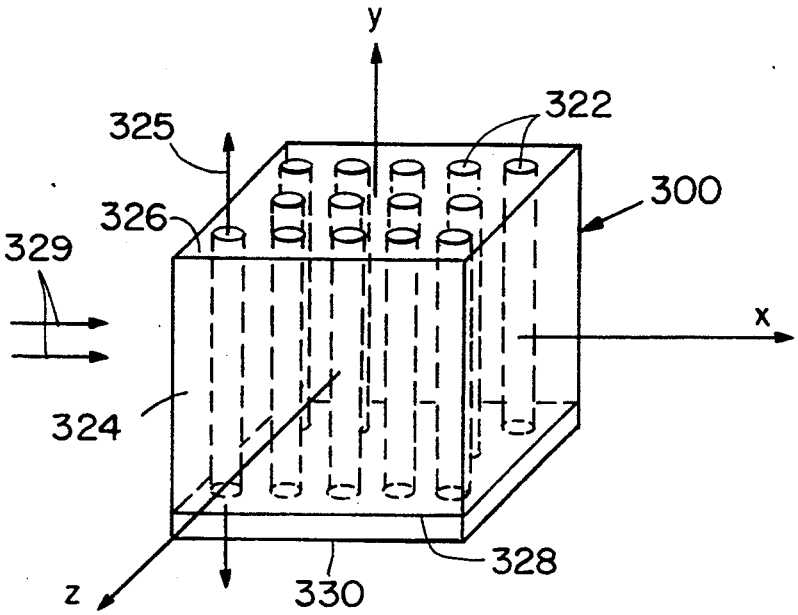
FIG. 2 is a perspective view of the periodic dielectric structure of FIG. 1*b* having two-dimensional periodicity.

FIG. 2 is a perspective view of the periodic dielectric structure 300 of FIG. 1*b* illustrating two-dimensional periodicity. The structure 300 includes a plurality of elongated elements 322 extending orthogonal to the substrate surface. The elements 322 may be formed of a non-conductive low-dielectric material disposed within a non-conductive high-dielectric substrate material 324. These elements may simply be bores, voids, or channels which may be filled with fluids or solids such as air and/or other liquid or solid material. The elements 322 extend periodically in parallel to one another through opposite faces 326 and 328 of the substrate material 324 and hence are deemed to have two dimensional periodicity. A longitudinal axis 325 extends through the center of each element 322 in the vertical or y-direction. The elements 322 are arranged periodically in two dimensions in a plane generally orthogonal to the longitudinal axes 325 extending through the elements 322.

The structure 300 can be positioned to filter incoming electromagnetic energy 329 polarized along an alignment axis (the y-axis) which extends parallel to the longitudinal axes 325 of the elements. The structure 300 reflects substantially all of the incident electromagnetic energy 329 having this polarity and having a frequency within the range of the photonic or frequency band gap. More specifically, electromagnetic energy within the frequency range of the band gap and polarized along the longitudinal axes of the elements 322 is substantially prevented from propagating through the structure 300.

Thus, the structure 300 operates as a band stop filter. The structure 300 is most effective for electromagnetic energy propagating in the x-z plane. The structure maintains a substantially constant band gap frequency range for radiation propagating along any incident angle in this plane.

Figure 3:
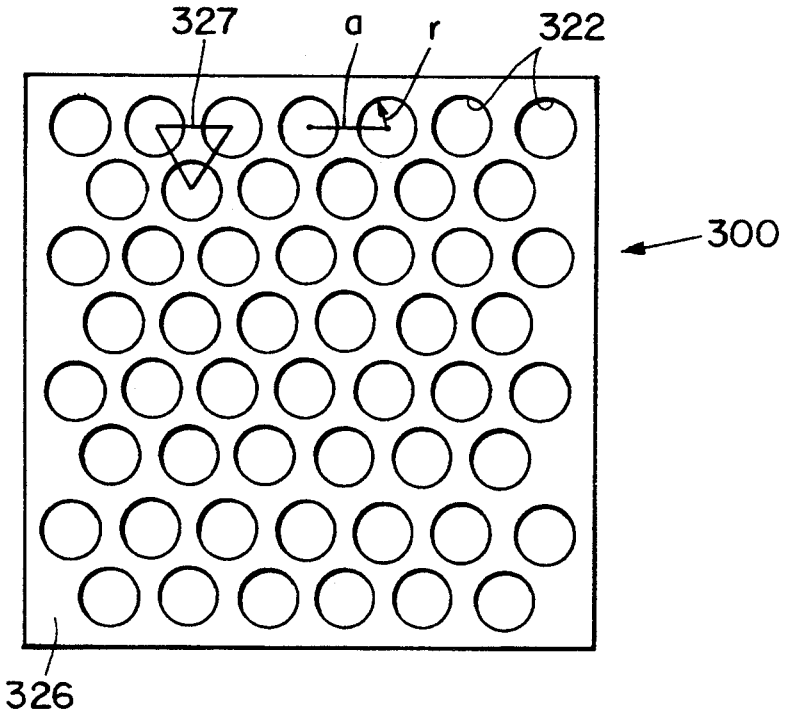
FIG. 3 is a top view of the periodic dielectric structure of FIG. 2.

FIG. 3 is a top view of the structure 300. Referring to FIG. 3, the elements 322 are preferably cylindrically shaped and extend in a two-dimensional periodic arrangement relative to the x-z plane or any plane parallel thereto. In one embodiment, the cylindrical elements 322 are periodically arranged to provide a triangular lattice. The lines 327 illustrate the triangular lattice arrangement of the cylindrical elements along the top face 326 of the substrate material 324. As previously noted, the cylindrical elements 322 can be simply regions of air or can include any other substantially non-conductive low-dielectric solid, fluid (liquid or gas) or gel material. Although cylindrical elements are described hereinafter, quasi-cylindrical elements or other shaped elongated elements may be employed.

Figure 4:
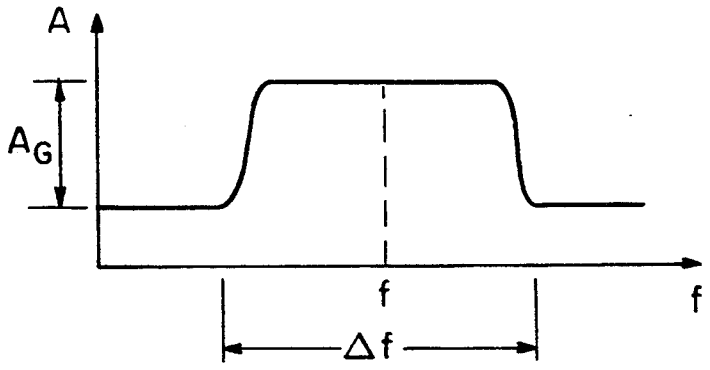
FIG. 4 is a graph showing the relationship between attenuation provided by the band gap and frequency.

A feature of the periodic dielectric structure is that the center frequency of the band gap, the bandwidth of the band gap (i.e., the stop band) and the band gap attenuation can be tailored for any frequency range in the microwave to ultraviolet bands ($10^6$ to $10^{15}$ Hz) during the fabrication of the structure. For the structure of FIG. 3, the center frequency (f), the bandwidth ($\Delta f$) and the band gap attenuation ($A_G$) of the band gap are shown in FIG. 4. The attenuation ($A_G$) of the band gap is proportional to the number of rows of elements 322. Thus, the attenuation ($A_G$) can be increased by providing additional rows. The center frequency (f) of the bandwidth ($\Delta f$) can be computed in accordance with the following equation:

$$f=[13.8(13/\mu\epsilon)^{\frac{1}{2}}]/a \text{ GHz}$$

where $\epsilon$=dielectric constant of the substrate material.

$\mu$=magnetic permeability of the substrate material, and, a=triangular lattice constant which corresponds to the distance in centimeters between centers of adjacent elements.

The location of the band gap on the frequency scale is determined by the center frequency. The size of the bandwidth ($\Delta f$) is determined by the radius (r) of the cylindrical elements 322 and the triangular lattice constant (a).

A two-dimensional periodic dielectric structure as shown in FIGS. 2 and 3 may be fabricated on a portion of a homogeneous or uniform semiconductor substrate as follows. First, the substrate portion is covered on one face with a mask which contains a two-dimensional array of holes of the size, spacing, and periodicity required for the desired band gap. The semiconductor and mask are then exposed to a highly directional reactive-ion etchant. The reactive-ion plasma is directed at the mask along the perpendicular axis, and vertical channels are created in the substrate at the position of the holes in the mask. The resulting array of elements forms the two-dimensional frequency or photonic band gap.

When a circuit is to be fabricated on the substrate, the periodic elements must be confined to an area which does not physically interfere with the circuit. First, the circuit is fabricated on the uniform substrate material by known techniques. Next, the elements are created by reactive- ion etching as described.

In the structure with two-dimensional periodicity, radiation is prevented from propagating in the x-z plane as shown in FIG. 2. However, radiation may propagate in the y-direction. Where this is undesirable, as in the present invention, a conducting plane 330 can be formed on the bottom surface 328 of the structure. The radiation is reflected back into the structure 300 toward the top surface 326 and then is transmitted into the air above the substrate.

Figure 5:
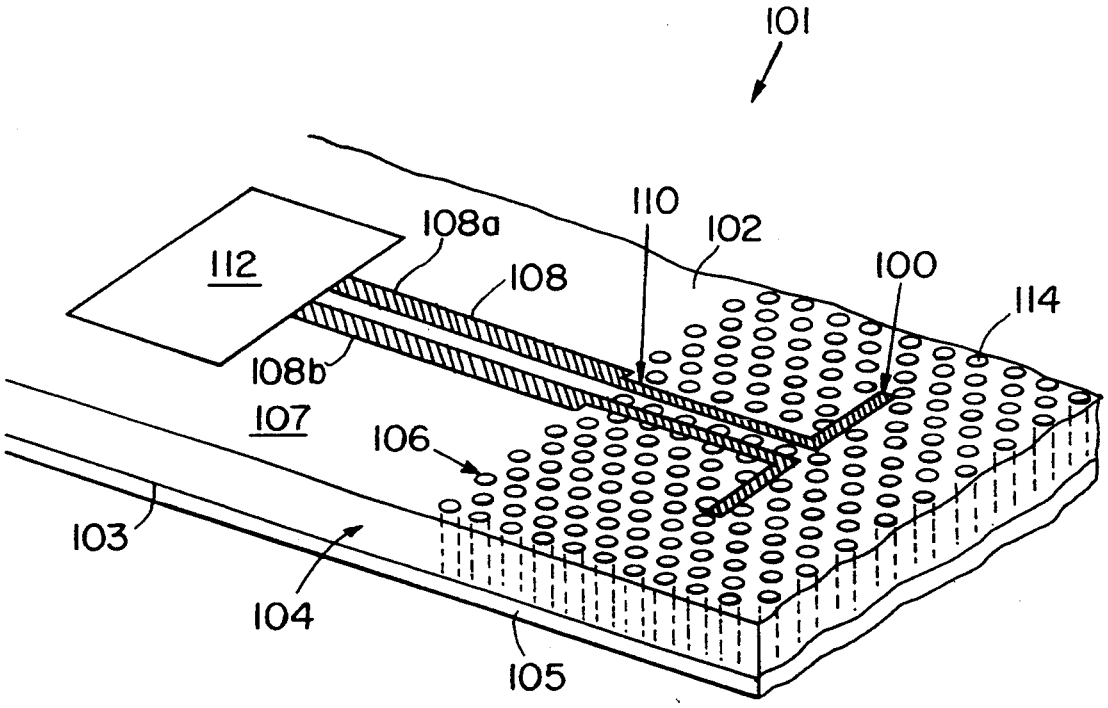
FIG. 5 is a schematic perspective view of a planar antenna utilizing a two-dimensional periodic dielectric structure in accordance with the present invention.

FIG. 5 schematically illustrates an antenna embodiment 101 of the present invention. A planar dipole antenna 100 is fabricated on the top surface 102 of a substrate 104 such as by depositing metallization on the substrate surface to form a dipole. The antenna can also be of the slot, spiral, bow-tie, log periodical or other type. The substrate 104 includes a region having a periodic dielectric structure 106 with two-dimensional periodicity formed by periodic transverse holes 114 formed in the substrate and a region of uniform semiconductor material 107. Because the structure has two-dimensional periodicity, radiation may propagate toward the bottom surface 103 of the substrate. A conducting plane 105 is formed by depositing or evaporating metallization on the bottom surface 103 of the substrate 104 to reflect radiation from the antenna 110 back out the top surface 102.

Conventional integrated circuits 112 are fabricated on the uniform region 107 of the substrate 104. The circuits 112 can include transmission lines, transmit and/or receive electronics, signal processing electronics and/or other circuitry and electronics associated with transmission and/or reception of electromagnetic radiation. Input/output ports of the circuits are connected to the two stripline elements 108*a* and 108*b* of the dipole 100.

The antenna dipole 100 is fabricated on the periodic structure region 106 of the substrate 104. The dipole metal is deposited on the substrate by standard evaporation techniques and is defined by standard photolithography techniques. The dipole 100 is located on the periodic structure 106 to prevent the radiation emitted by the dipole 100 or radiation being received by the dipole 100 from being trapped in the substrate 104 as described previously.

The dipole 100 is driven by a coplanar stripline 108. A transition 110 in the dimensions of the stripline 108 is made to obtain a satisfactory impedance match between the uniform dielectric region 107 and the periodic dielectric structure region 106.

Figure 6:
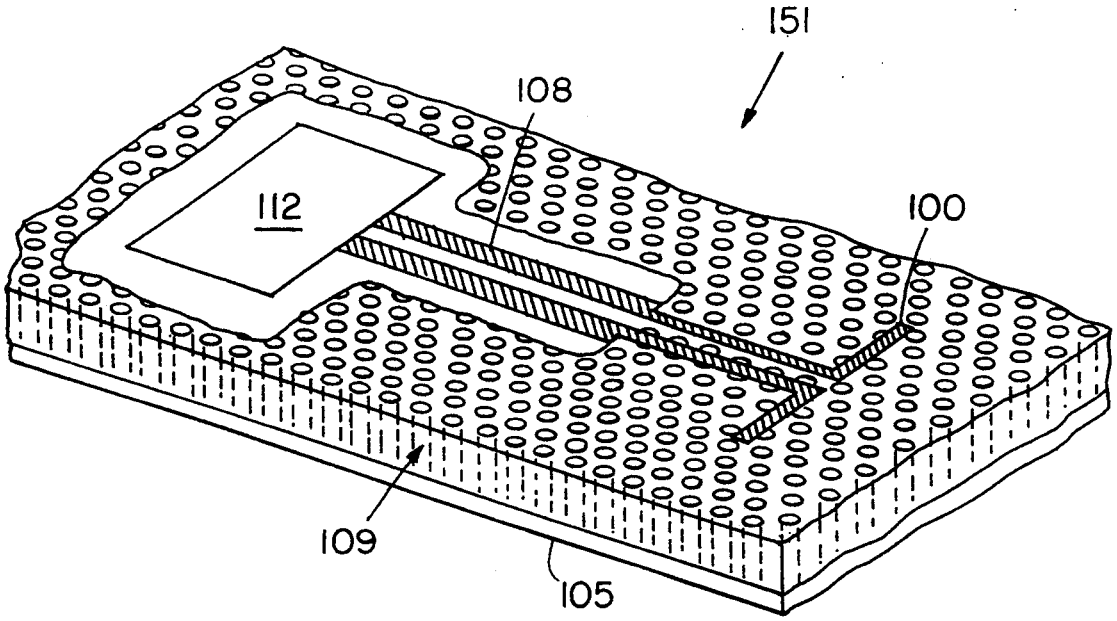
FIG. 6 is a schematic perspective view of an alternate embodiment of a planar antenna with isolation utilizing a two-dimensional periodic dielectric structure in accordance with the present invention.

An alternative embodiment of the antenna is shown in FIG. 6. As with the antenna of FIG. 5, the dipole 100 is fabricated on top of a periodic dielectric structure having two-dimensional periodicity. In this embodiment, the circuitry 112 and the stripline 108 are fabricated on uniform substrate. However, they are also surrounded by the periodic dielectric structure. This configuration serves to isolate the overall circuit from other circuits (not shown) which may be fabricated on the same substrate. Radiation from the circuitry 112 or the stripline 108 at a frequency within the band gap of the surrounding periodic dielectric cannot propagate to other circuits on the substrate. Thus interference or "crosstalk" among circuits on the substrate is virtually eliminated.

Figure 7:
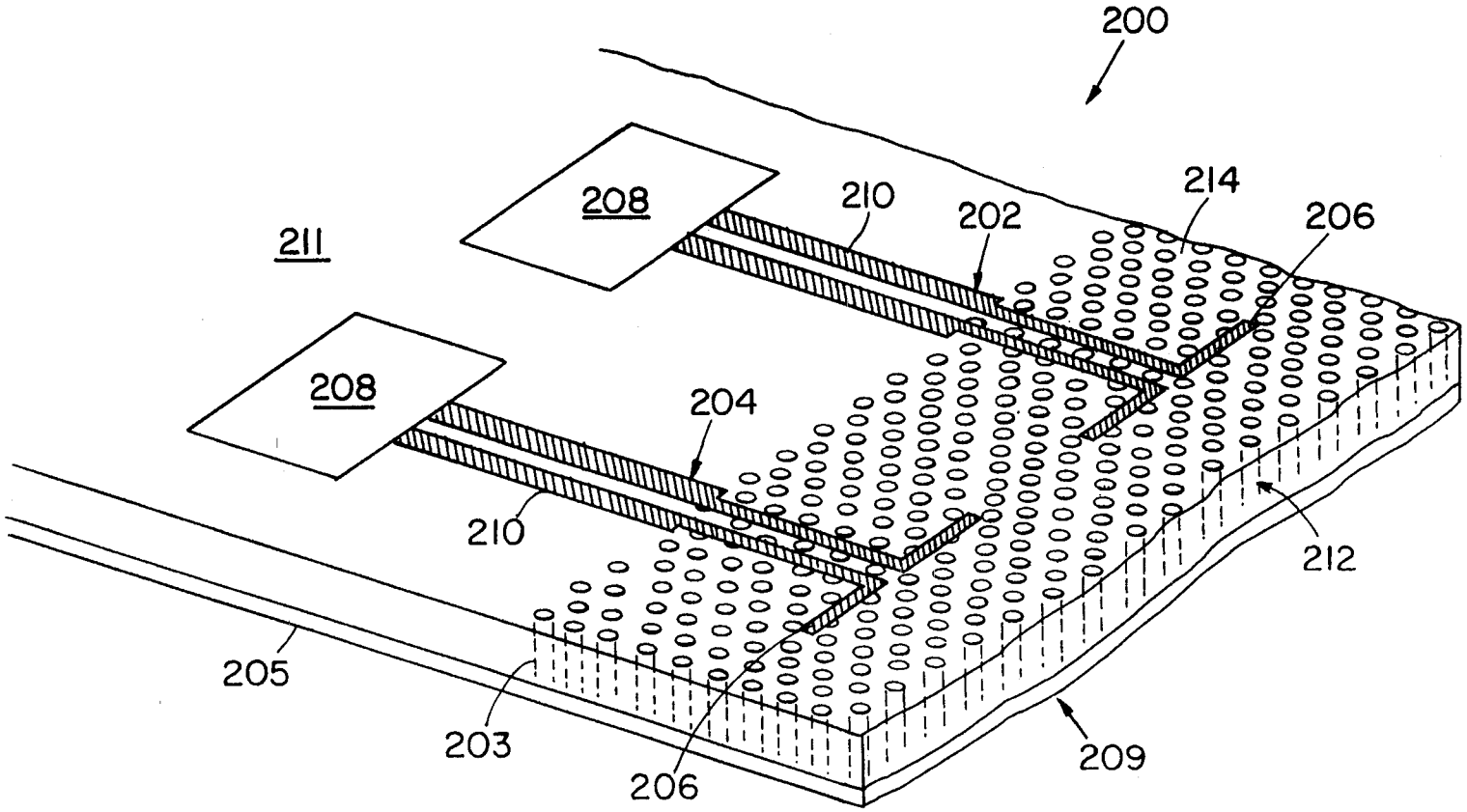
FIG. 7 is a schematic perspective view of two elements of a phased array utilizing a two-dimensional periodic dielectric structure in accordance with the present invention.

FIG. 7 illustrates a portion of a phased array 200 in accordance with the present invention. Two elements 202, 204 of the array 200 are shown. Each element comprises a dipole 206 connected to associated circuitry 208 by a coplanar stripline 210.

The entire array 200 is fabricated on the top surface 214 of a substrate 209. The substrate 209 comprises a uniform region 211 and a periodic dielectric region 212. The periodic dielectric region 212 has two-dimensional periodicity. The stripline 210 and associated circuitry 208 for each element are fabricated on the uniform region 211 of the substrate 209. The dipoles 206 are fabricated on the periodic dielectric region 212.

Each element of the array operates at a frequency within the band gap of the periodic structure. Consequently, the periodic structure serves to increase the efficiency of the phased array. Each element of the array performs in a manner similar to that of the single antenna embodiments described above. Radiation from the dipole cannot propagate into the substrate. The radiation is emitted from the dipole away from the substrate into space. Because the periodic structure has two-dimensional periodicity, a conducting plane 205 is fabricated on the bottom surface 203 to reflect radiation from the bottom surface toward the top surface.

Figure 8:
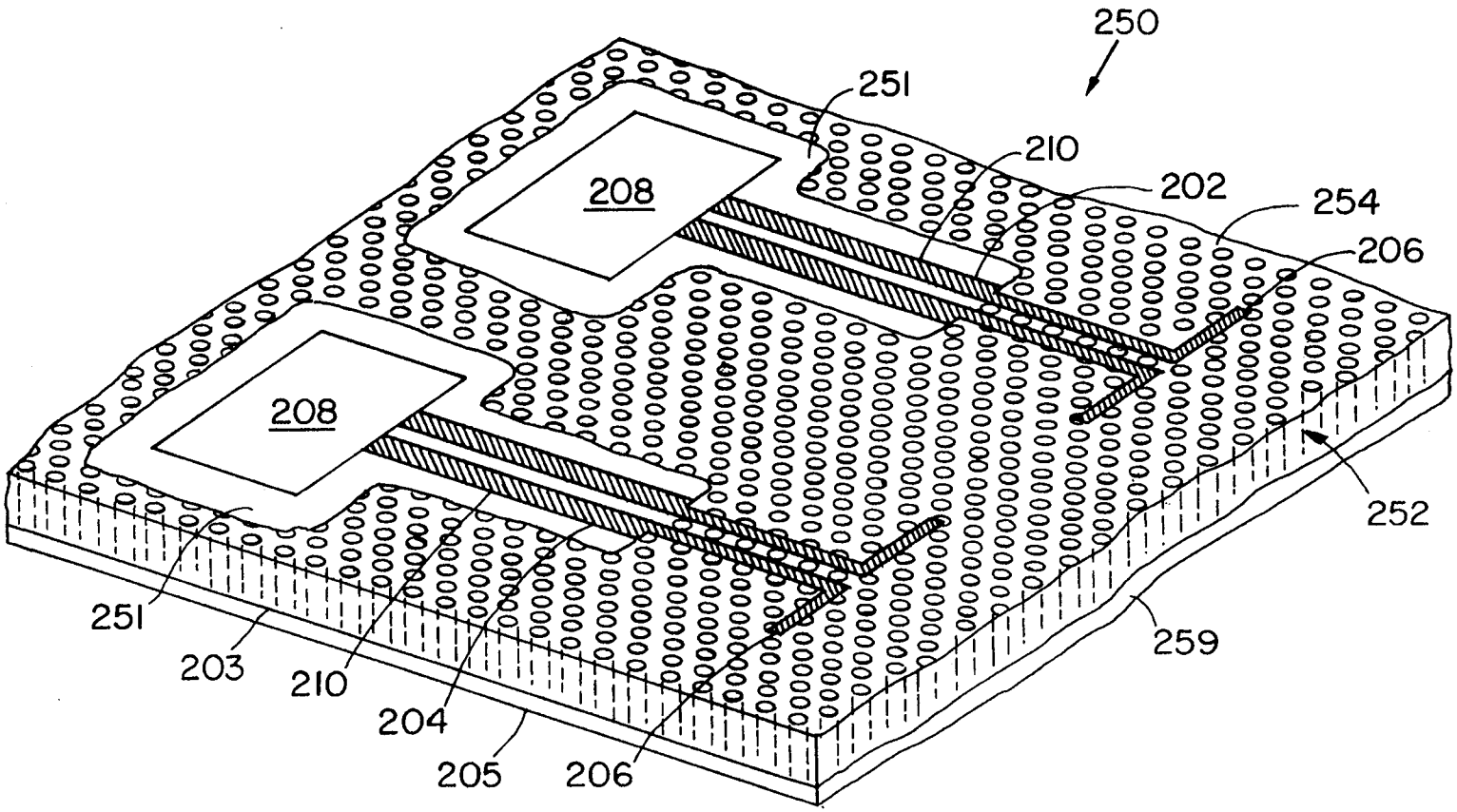
FIG. 8 is a schematic perspective view of two elements of an alternate embodiment of a phased array with isolation between elements utilizing a two-dimensional periodic dielectric structure in accordance with the present invention.

FIG. 8 depicts another phased array embodiment 250 of the present invention. As with the embodiment of FIG. 7, the array elements 202, 204 are fabricated on the top surface 254 of a substrate 259. The dipoles 206 are fabricated on a periodic dielectric structure 252. Circuits 208 and striplines 210 are fabricated on uniform substrate material 251.

In the embodiment of FIG. 8, the periodic crystal structure is also disposed between the circuits 208 and striplines 210 of the individual elements 202, 204. The periodic structure serves to isolate the elements 202, 204 of the array 250 from each other. Radiation from any of the circuits in the array at a frequency within the band gap of the periodic structure cannot propagate through the substrate. Thus, interference or "crosstalk" among elements or devices within elements which would take place through a conventional substrate is virtually eliminated. The efficiency of the previous embodiment is maintained here as well by the periodic structure beneath the dipoles 206 and by the conductor 205 on the bottom surface 203 of the substrate 259.

The devices described to this point have incorporated periodic dielectric structures having two-dimensional periodicity. However, all of the devices can also be produced with periodic dielectric structures having three-dimensional periodicity.

Figure 9:
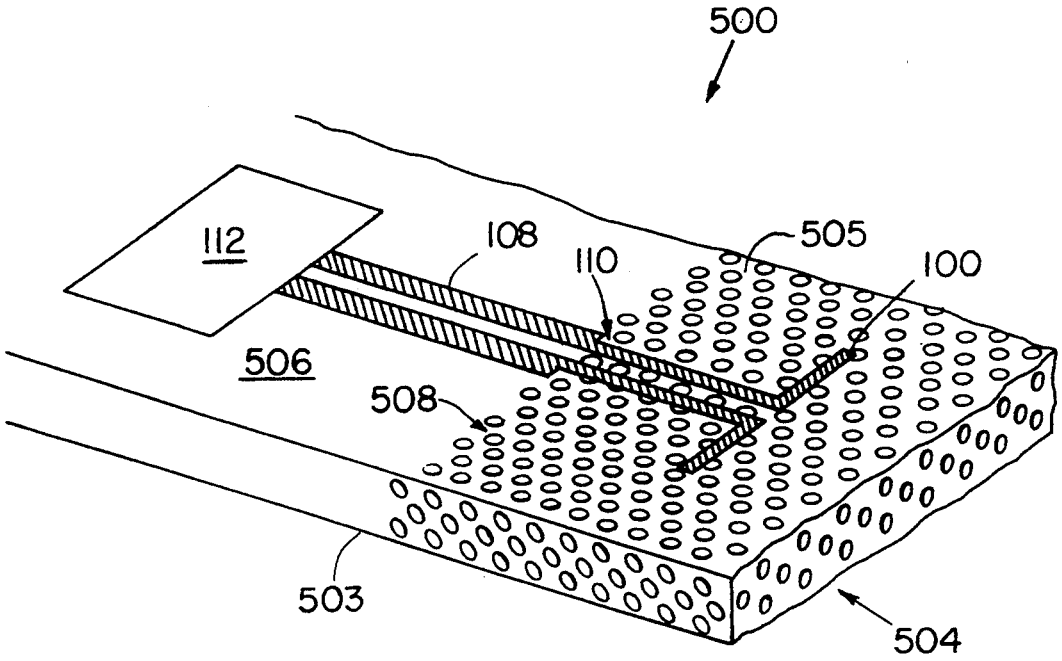
FIG. 9 is a schematic perspective view of a planar antenna utilizing a three-dimensional periodic dielectric structure in accordance with the present invention.

FIG. 9 depicts another embodiment of an antenna 500 in accordance with the present invention. The antenna 500 comprises a dipole 100, stripline 108 and associated circuitry 112 fabricated on the top surface 505 of a substrate 504. The substrate 504 comprises a uniform dielectric region 506 and a periodic dielectric region 508 having three-dimensional periodicity.

The dipole 100 is fabricated on top of the periodic-dielectric region 508. The stripline 108 and associated circuitry 112 are fabricated on top of the uniform dielectric region 506. A transition 110 in the dimensions of the stripline 108 is made to obtain a satisfactory impedance match between the uniform dielectric region 506 and the periodic dielectric region 508.

The materials used for the substrate 504 are the same in the three-dimensional case as in the two-dimensional case described previously. Also, the circuits 112, stripline 108, and dipole 100 are fabricated on the surface of the substrate 504 in the same manner as previously noted.

The three-dimensional periodic dielectric structure 508 is fabricated in a slightly different manner than the two-dimensional structure. The top surface of a uniform semiconductor substrate is covered with a mask having a two-dimensional array of holes. In one embodiment, the two-dimensional array has a triangular lattice pattern. The semiconductor and mask are exposed to a reactive-ion etchant. The etchant plasma is directed successively at three different angles with respect to the axis perpendicular to the top surface of the substrate. The angles are each oriented down 35.26° from the perpendicular and are separated by 120° from each other in azimuth. The etching process is carried out through the entire substrate. The resulting channels form a three-dimensional face-centered cubic lattice. The electromagnetic dispersion relation in this lattice will exhibit a photonic or frequency band gap.

With three-dimensional periodicity, the periodic dielectric structure prevents propagation of electromagnetic radiation within the band gap along all three axes. Radiation cannot propagate laterally through the substrate as in the two-dimensional case. But also, it cannot propagate toward the bottom surface 503 of the substrate 504. Therefore, no conductor is needed on the bottom surface 503 to reflect radiation back toward the top surface 505. As in the two-dimensional case, because radiation does not propagate into the substrate 504, an efficient antenna 500 is achieved.

Figure 10:
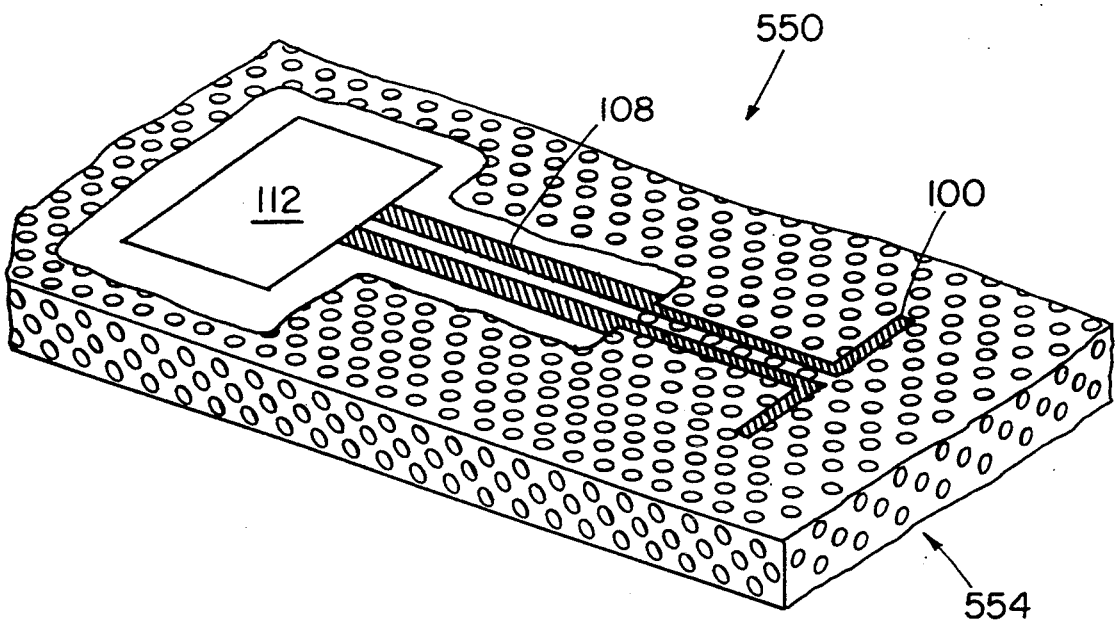
FIG. 10 is a schematic perspective view of an alternate embodiment of a planar antenna with isolation utilizing a three-dimensional periodic dielectric structure in accordance with the present invention.

FIG. 10 depicts an antenna 550 utilizing a substrate 554 having a periodic dielectric structure with three-dimensional periodicity. As described above in connection with FIG. 6, this antenna 550 is isolated from other circuits (not shown) mounted on the substrate 554. The periodic dielectric prevents interference between the antenna 550 and the other circuits. Because the periodic dielectric has three-dimensional periodicity, no conductor is needed on the bottom surface.

Figure 11:
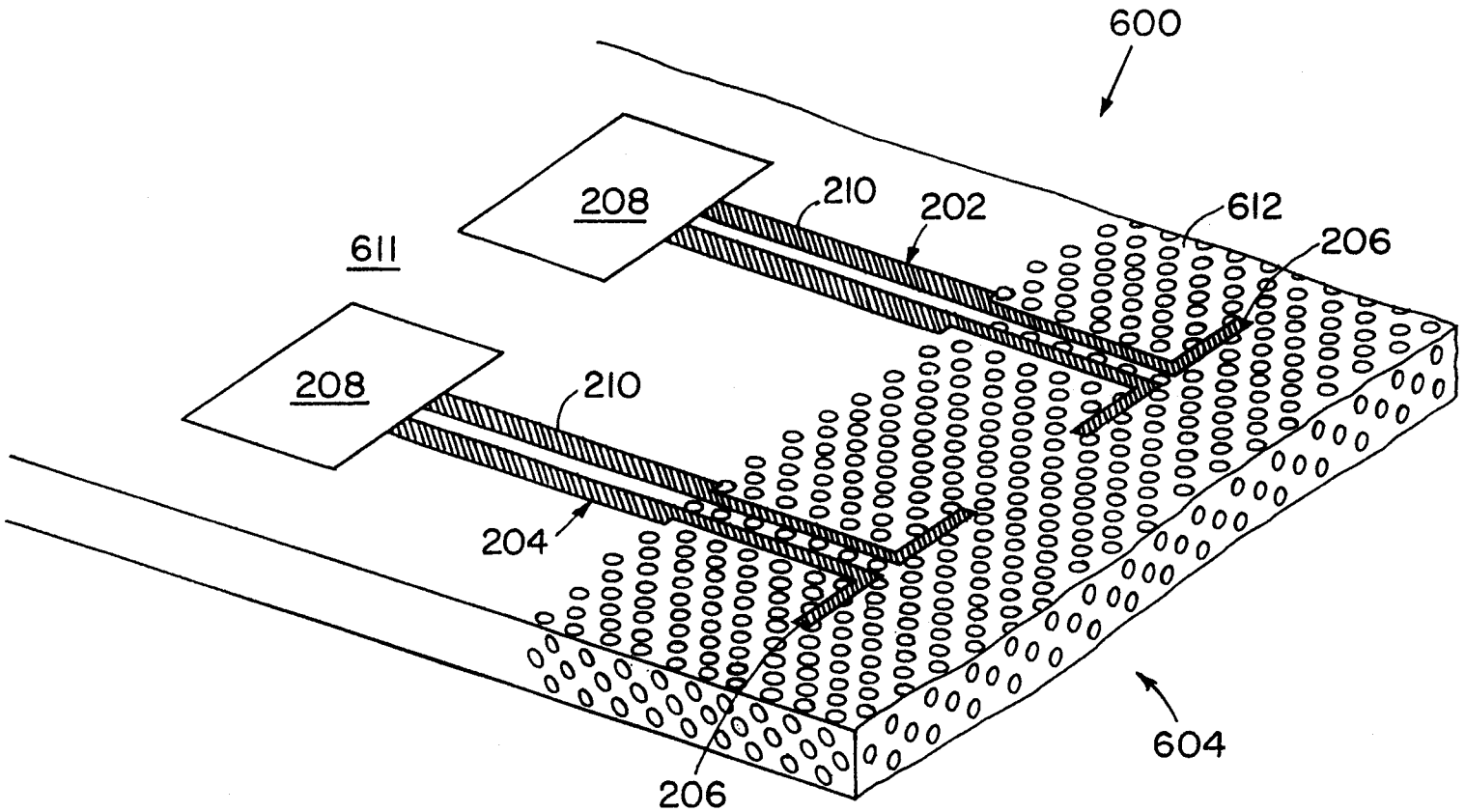
FIG. 11 is a schematic perspective view of two elements of a phased array utilizing a three-dimensional periodic dielectric structure in accordance with the present invention.
Figure 12:
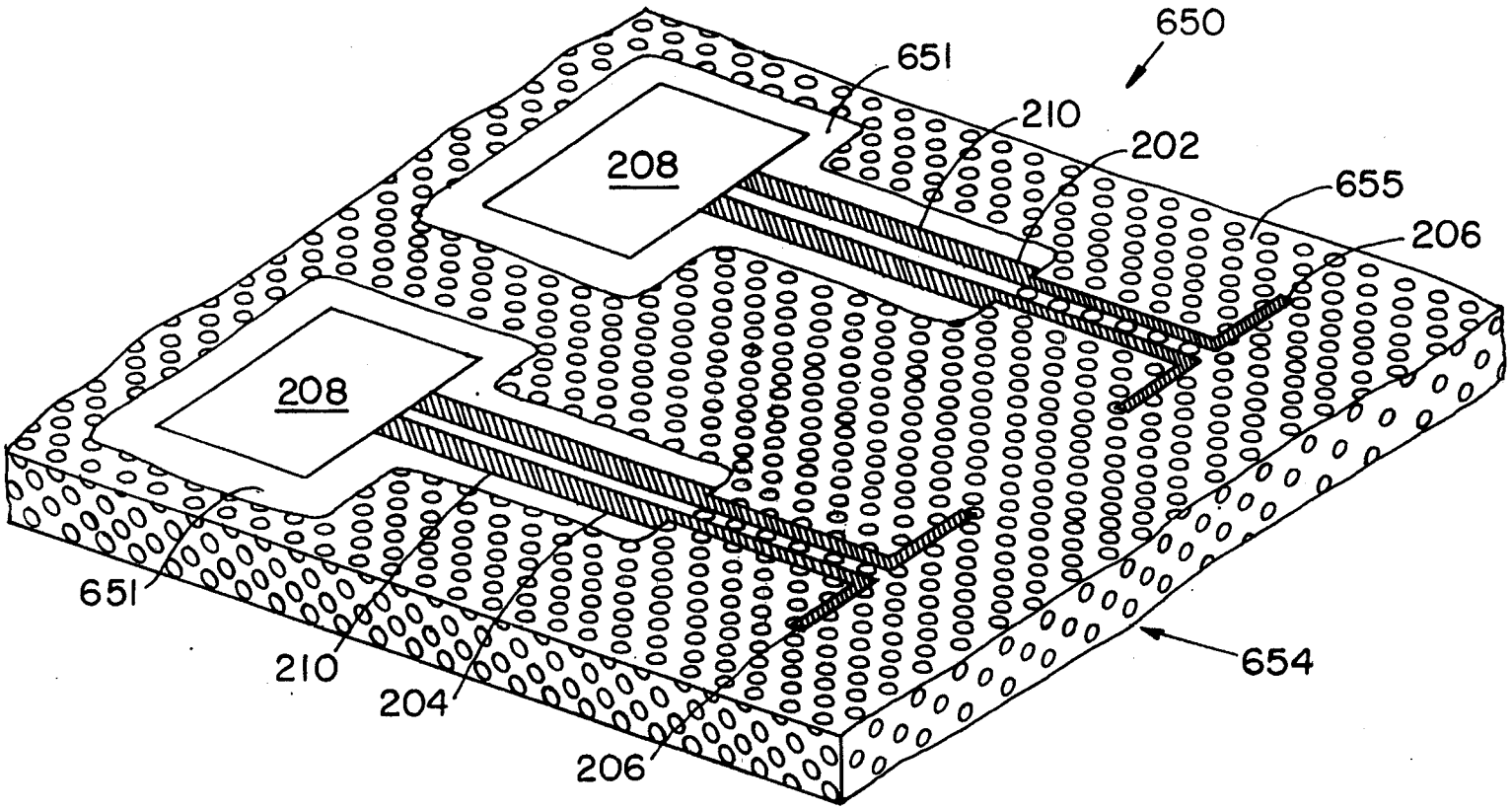
FIG. 12 is a schematic perspective view of two elements of an alternate embodiment of a phased array with isolation between elements utilizing a three-dimensional periodic dielectric structure in accordance with the present invention.

FIGS. 11 and 12 depict two phased array embodiments of the present invention which utilize the three-dimensional periodic dielectric structure. FIG. 11 shows part of a phased array 600 having two antenna elements 202, 204 mounted on a substrate 604. The substrate 604 comprises a uniform dielectric region 611 and a periodic dielectric region 612 having three-dimensional periodicity.

The dipoles 206 are fabricated on top of the periodic dielectric region 612. The striplines 210 and associated circuitry 208 are fabricated on the uniform dielectric region 611. Once again, the periodic dielectric structure provides the array 600 with improved efficiency.

FIG. 12 shows a phased array 650 with isolation between the array elements 202, 204. As described above in connection with FIG. 8, the periodic dielectric structure between the elements prevents interference or crosstalk through the substrate 654.

Referring to FIG. 12, the substrate 654 comprises a periodic structure 655 having a three-dimensional periodicity. The dipoles 206 are fabricated on top of the periodic structure 655. The stripline 210 and associated circuits 208 are fabricated on top of uniform dielectric 651. The periodic structure 655 separates the areas of uniform dielectric 651 to prevent interference between the elements 202, 204. The array 650 has improved efficiency because of the periodic structure 655 beneath the dipoles 206.

While this invention has been particularly shown and described with references to preferred embodiments thereof, it will be understood by those skilled in the art that various changes in form and details may be made therein without departing from the spirit and scope of the invention as defined by the appended claims.

For example, emphasis has been placed on using materials with high dielectric constant semiconductors as the substrate material. However, because low dielectric materials can be fabricated with the periodic dielectric structure, it is contemplated that they can also be used as substrates for efficient antennas.

I claim:

1. An apparatus for transmission or reception of electromagnetic radiation along a path of propagation comprising:

a substrate having a spatially periodic dielectric lattice structure in which the lattice dimensions are proportioned to produce a band gap at a band of electromagnetic radiation frequencies such that radiation at such frequencies is substantially prevented from propagating in at least one dimension within the substrate; and an antenna overlying said substrate and exposed to said path of propagation for transmitting or receiving radiation at said band of frequencies.

2. The apparatus of claim 1 wherein the periodic dielectric lattice structure is periodic in two dimensions.

3. The apparatus of claim 1 wherein the periodic dielectric lattice structure is periodic in three dimensions.

4. The apparatus of claim 1 wherein the substrate comprises a semiconductor material.

5. The apparatus of claim 1 wherein the antenna comprises a dipole antenna driven by a stripline.

6. The apparatus of claim 1 wherein:

the antenna is one of a plurality of like elements of a phased array of antennas formed on said substrate; and wherein interference among the elements of the phased array due to propagation of electromagnetic radiation within the substrate is substantially eliminated by said band gap.

7. The apparatus of claim 1 wherein the substrate comprises gallium arsenide.

8. The apparatus of claim 1 wherein the substrate comprises silicon.

9. The apparatus of claim 1 wherein the substrate comprises indium phosphide.

10. The apparatus of claim 1 wherein the substrate comprises a III-V compound semiconductor.

11. The apparatus of claim 1 wherein the substrate comprises a ceramic material.

12. The apparatus of claim 1 wherein the band of electromagnetic radiation frequencies of the band gap comprises a range of $10^6$ through $10^{15}$ Hz.

13. A monolithic transmitter/receiver device for receiving or transmitting energy in a path of propagation comprising:

a semiconductor substrate having a first portion in which a spatially periodic dielectric lattice structure is formed, said lattice structure having dimensions proportioned to produce a frequency band gap at a band of electromagnetic radiation frequencies such that radiation at said frequencies is substantially prevented from propagating in at least one dimension within the periodic dielectric lattice structure;

an antenna exposed to said path of propagation formed over a surface of the periodic dielectric structure, said antenna being operable at operating frequencies within the frequency band gap such that electromagnetic energy propagating from or to the antenna is prevented from entering into the substrate; and a transmit/receive circuit formed in a second portion of the substrate and electrically coupled to the antenna.

14. The device of claim 12 wherein the periodic dielectric structure is formed of a periodic array of holes extending transverse to the plane of the substrate surface over which the antenna is formed.

15. The device of claim 12 wherein the periodic dielectric lattice structure is periodic in two dimensions.

16. The device of claim 12 wherein the periodic dielectric lattice structure is periodic in three dimensions.

17. The device of claim 12 wherein the periodic dielectric structure is a semiconductor in which a periodic pattern of holes is formed.

18. The device of claim 12 wherein the antenna is a dipole.

19. The device of claim 12 wherein the antenna transmits electromagnetic radiation at an operating frequency.

20. The device of claim 12 wherein the antenna receives electromagnetic radiation at an operating frequency.

21. The device of claim 12 wherein the substrate is comprised of silicon.

22. The device of claim 12 wherein the substrate is comprised of gallium arsenide.

23. The device of claim 12 wherein the substrate is comprised of III-V material.

24. The device of claim 12 wherein the substrate is comprised of indium phosphide.

25. The device of claim 12 wherein the substrate is formed of opto-electronic material.

26. The device of claim 12 wherein the substrate comprises a ceramic material.

27. The device of claim 12 wherein the antenna is one of a plurality of antennas forming a phased array.

28. The device of claim 12 wherein the band of electromagnetic radiation frequencies of the band gap comprises a range of $10^6$ through $10^{15}$ Hz.

29. A method of substantially eliminating propagation of electromagnetic radiation within a substrate around an antenna circuit mounted on a surface of the substrate, said method comprising the steps of:

providing a spatially periodic dielectric lattice structure on the substrate, said periodic dielectric lattice structure having dimensions proportioned to produce a frequency band gap defining a band of electromagnetic radiation frequencies such that electromagnetic radiation at such frequencies is substantially prevented from propagating in at least one dimension within the structure, said frequency band gap including an operating frequency at which the antenna circuit is operable;

mounting the antenna circuit on the surface of the periodic dielectric lattice structure exposed to said radiation; and operating the antenna circuit at the operating frequency such that propagation of electromagnetic radiation at the operation frequency within the structure is substantially eliminated.

30. The method of claim 29 wherein the antenna circuit comprises a dipole antenna driven by a stripline.

31. The method of claim 29 wherein:

the antenna circuit is one of a plurality of like elements of a phased array of antenna circuits; and interference among the elements of the phased array due to propagation of electromagnetic radiation within the substrate is substantially eliminated.

32. The method of claim 29 wherein the operating step comprises transmitting electromagnetic radiation with the antenna circuit at the operating frequency.

33. The method of claim 29 wherein the operating step comprises receiving electromagnetic radiation with the antenna circuit at the operating frequency.

34. The method of claim 29 wherein the band of electromagnetic radiation frequencies of the band gap comprises a range of $10^6$ through $10^{15}$ Hz.

35. The method of claim 29 wherein the periodic dielectric lattice structure is periodic in two dimensions.

36. The method of claim 29 wherein the periodic dielectric lattice structure is periodic in three dimensions.

37. A method of isolating antenna elements in a phased array comprising:

providing a substrate, a portion of said substrate having a spatially periodic dielectric lattice structure, said periodic dielectric lattice structure having dimensions proportioned to produce a frequency band gap defining a band of electromagnetic radiation frequencies such that electromagnetic radiation at such frequencies is substantially prevented from propagating in at least one dimension within the periodic dielectric structure; and mounting a plurality of antenna circuits on a surface of the substrate exposed to said radiation, said antenna circuits being operable at operating frequencies within the frequency band gap of the periodic dielectric lattice structure, such that when the antenna circuits operate, interference among them caused by propagation of electromagnetic radiation within the substrate is substantially eliminated.

38. The method of claim 37 wherein the antenna circuits operate by transmitting electromagnetic radiation at an operating frequency.

39. The method of claim 37 wherein the antenna circuits operate by receiving electromagnetic radiation at an operating frequency.

40. The method of claim 37 wherein the band of electromagnetic radiation frequencies of the band gap comprises a range of $10^6$ through $10^{15}$ Hz.

41. The method of claim 37 wherein the periodic dielectric lattice structure is periodic in two dimensions.

42. The method of claim 37 wherein the periodic dielectric lattice structure is periodic in three dimensions.

43. A method of efficiently operating an antenna comprising:

providing a substrate, a portion of said substrate having a spatially periodic dielectric lattice structure having dimensions proportioned to produce a frequency band gap defining a band of electromagnetic radiation frequencies such that electromagnetic radiation at such frequencies is substantially prevented from propagating in at least one dimension within the periodic dielectric structure;

mounting the antenna on a surface of the substrate exposed to such radiation; and operating the antenna at an operating frequency within the band gap of the periodic dielectric lattice structure such that propagation of electromagnetic radiation at the operating frequency within the substrate is substantially eliminated.

44. The method of claim 43 wherein the step of operating the antenna comprises transmitting electromagnetic radiation at the operating frequency.

45. The method of claim 44 wherein the radiation transmitted by the antenna is concentrated in a direction away from the surface of the substrate into space.

46. The method of claim 43 wherein the step of operating the antenna comprises receiving electromagnetic radiation at the operating frequency.

47. The method of claim 43 wherein the band of electromagnetic radiation frequencies of the band gap comprises a range of $10^6$ through $10^{15}$ Hz.

48. The method of claim 43 wherein the periodic dielectric lattice structure is periodic in two dimensions.

49. The method of claim 43 wherein the periodic dielectric lattice structure is periodic in three dimensions.

50. A monolithic phased array comprising:

a substrate in which a spatially periodic dielectric lattice structure is formed, said structure having dimensions proportioned to provide a frequency band gap at a band of electromagnetic radiation frequencies such that electromagnetic radiation at such frequencies is substantially prevented from propagating in at least one dimension within the periodic dielectric lattice structure; and a plurality of antennas formed on a surface of the substrate exposed to such radiation, said antennas being operable at operating frequencies within the frequency band gap such that interference among the antennas caused by electromagnetic transmission within the substrate is substantially eliminated.

51. The phased array of claim 50 wherein the band of electromagnetic radiation frequencies of the band gap comprises a range of $10^6$ through $10^{15}$ Hz.

52. The phased array of claim 50 wherein the periodic dielectric lattice structure is periodic in two dimensions.

53. The phased array of claim 50 wherein the periodic dielectric lattice structure is periodic in three dimensions.

* * * * *